US007472852B2

(12) United States Patent
Huang

(10) Patent No.: US 7,472,852 B2
(45) Date of Patent: Jan. 6, 2009

(54) METHOD FOR FINING POWDER AND APPARATUS EMPLOYING THE SAME

(76) Inventor: Chiung-Cheng Huang, 5F, No. 412-21, Sec. 2, Jhongshan Rd., Taping City, Taichung County (TW)

( * ) Notice: Subject to any disclaimer, the term of this patent is extended or adjusted under 35 U.S.C. 154(b) by 67 days.

(21) Appl. No.: 11/520,573

(22) Filed: Sep. 14, 2006

(65) Prior Publication Data

US 2008/0121741 A1 May 29, 2008

(51) Int. Cl.
*B02C 19/00* (2006.01)

(52) U.S. Cl. ..... 241/5; 241/19; 241/27; 241/40

(58) Field of Classification Search ..... 241/5, 241/39, 40, 19, 27
See application file for complete search history.

(56) References Cited

U.S. PATENT DOCUMENTS 1,573,017 A * 2/1926 Podszus ..... 241/5
2,521,000 A * 9/1950 Crowley et al. ..... 241/39
3,688,991 A * 9/1972 Andrews ..... 241/5
4,406,409 A * 9/1983 Durek ..... 241/5
6,708,909 B2 * 3/2004 Toda et al. ..... 241/1

* cited by examiner

*Primary Examiner*—Mark Rosenbaum
(74) *Attorney, Agent, or Firm*—Rosenberg, Klein & Lee

(57) ABSTRACT

The present invention relates to a method for fining powders and an apparatus employing the same. By fast rotating the collision plates in a chamber, the powders can be continuously pulverized at high velocity. The chamber is maintained in a stable low pressure, so that gas flows are generated by planes of the rotating collision plates and the powders can be sorted. The present invention can perform functions of both pulverizing powders of D50<20 μm to D50<2.0 μm and sorting them with advantages of dry, low temperature, saving-energy, less consumed-material and high efficiency. The present invention is particularly suitable for oxides unable to be fined by high-temperature pyrolysis, powders having problems of changing properties at high temperature or aggregation. The present invention also provides a low-cost technology for certain powders such as cement.

9 Claims, 10 Drawing Sheets

| | | | | | | | | | | |
|---|---|---|---|---|---|---|---|---|---|---|
| D | 0.7 | 0.9 | 1.0 | 1.4 | 1.7 | 2.0 | 2.6 | 3.2 | 4.0 | 5.0 |
| C% | 16.6 | 23.1 | 26.4 | 39.5 | 48.5 | 56.5 | 70.1 | 80.4 | 89.7 | 96.1 |
| D | 6.0 | 8.0 | 10.0 | 12.0 | 15.0 | 15.0 | 23.0 | 30.0 | 36.0 | 43.0 |
| C% | 98.9 | 100.0 | 100.0 | 100.0 | 100.0 | 100.0 | 100.0 | 100.0 | 100.0 | 100.0 |
| D | 56.0 | 70.0 | 90.0 | 110.0 | 135.0 | 165.0 | 210.0 | 260.0 | 320.0 | 400.0 |
| C% | 100.0 | 100.0 | 100.0 | 100.0 | 100.0 | 100.0 | 100.0 | 100.0 | 100.0 | 100.0 |

FIG. 7

METHOD FOR FINING POWDER AND APPARATUS EMPLOYING THE SAME

BACKGROUND OF THE INVENTION

1. Field of the Invention

The present invention relates to a method for fining powders and an apparatus employing the same, which can particularly reduce sizes of fragile powders from D50<20 μm to D50<2.0 μm with advantages of dry, low-temperature, saving-power, less consumed material and high efficiency.

2. Related Prior Arts

Conventionally, the powders are usually fined in a static state by applying pressure thereon, i.e., grinding or milling.

However, sizes of the fined powders are limited by applying the conventional technologies. The milling tool has to be replaced with a new one when the surface thereof is too rough to mill the powders. The applied kinetic energy will be lost as friction occurs between the milling tool and the powders and is transformed into heat. For example, the ball mill can mill cement powders to a specific area about 3,500 and D50<20 μm, but more milling will be not economic or result in aggregation. In principle, each of the raw powders has to be milled as 1,000 fine powders if a specific area 11,000 and a diameter D50<2.0 μm are desired, and it is impossible for current milling tools to achieve in a short period.

The current fining technologies can be classified into dry processes and wet (attriting) processes. For cement capable of hydration with water, dry processes are desired, for example, by ball mill or roller mill. The pulverized powders are delivered to a screening or sieving machine to collect powders with desired diameter. However, it's difficult to acquire cement powders with D50<20 μm by the conventional processes, and therefore high-pressure mills are developed. JP No. 8243427, JP No. 1284342, JP No. 8164345 and CN No. 1593771 provided similar apparatuses, in which several rollers are used to press and grind the powders and intervals between the rollers are adjustable. Another dry process is developed in which the powders are carried with the high-pressure gas flow and collide with each other. For example, CN No. 1,483,516 and JP No. 2002-079133 disclosed a jet flow or a special nozzle to fast deliver the powders and achieve collisions therebetween. However, collisions between the powders are not efficient as the powders are too small and will exit from the chamber very soon with the high-pressure air flow. This process consumes a lot of electricity and has unsatisfying yield. U.S. Pat. No. 5,839,670 combined the rollers and a jet flow to promote the fining effect. JP No. 2005-205266, JP No. 2005-177704, JP No. 2002-346411 and U.S. Pat. No. 5,354,002 further provided apparatuses having multiple cones or recycling ducts which achieve a sorting effect according to specific distribution of air flows. Such structures perform both pulverization and sorting effects. For the above attriting mill, proper media (grinding aid) are needed to avoid aggregation and cool the material, which absolutely increases cost and causes the problem of recycling the media.

In general, the powders can be fined either by collisions therebetween or colliding with a fix structure, and the fining effect varies with energy thereof. Further, the fined powders can be sorted according to deviation of the gas flows. To overcome the problems of the conventional technologies, the present invention provides a novel method and apparatus efficiently fine the powders with lower cost.

SUMMARY OF THE INVENTION

The object of the present invention is to provide a method for fining powders from D50<20 μm to D50<2.0 μm with advantages of dry, low temperature, saving-power, less consumed-material and high efficiency.

In the present invention, plane surfaces of collision plates rotating with high speeds are provided to pulverize the powders which move fast with accelerators. The collision plates are housed in a chamber of stable low pressure, so that the powders can collide with the plates many times for an instant. The powders can move faster due to reaction and resistance of the low-density air, and thus have more kinetic energy to collide the collision plates more frequently. The plane surfaces of the rotating collision plates also generate gas flows of the same direction to raise the fined powders to exit from an outlet on the top of the chamber, and the coarse powders having higher kinetic energy are left to collide with the plates. The present invention preferably includes several collision plates and thus performs functions of pulverizing and sorting the powders, which is never seen in prior arts.

The fining process of the present invention is different from the traditional polishing or grinding process and comprises steps of:

loading the powders of D50<20 μm with an initial speed (about 10 m/s) into the low-pressure chamber, and continuously collide with the plane surfaces of the collision plates disposed in the chamber and fast rotating; and the powders will move faster due to reaction so as to collide with the collision plate with more kinetic energy. When the collision force is larger than the aggregation force, the powders will be fined, i.e., collisions of the powders are directly proportional to the energy.

The principles used in the present invention are as follows:

1. Eliminating the aggregation force of the powders in a physical manner

When the destruction energy is larger than the aggregation energy, the powders will be fined instantly, i.e., number of the fined powders is proportional to the destruction energy.

2. When the powders are suspending or flying in the air, frictions therebetween will disappear and thus kinetic energy thereof is remained, temperature will not raise with frictions and no aggregation occurs.
3. The chamber is maintained at low pressure (low air density) to facilitate motion of the powders having the maximum kinetic energy so that the powders can cross the force field and collide with the collision plates.
4. The powders are fined from D50<20 μm to D50<2.0 μm, i.e., 1,000 times, and the coarse powders and the fine powders are separated in a collision area or a non-collision area by controlling the stable low pressure and fast rotating the collision plates to generate a weak force field. The inside pressure of the chamber and the rotary speed of the collision plates may determine strength of the force field and thus serve as indexes of the fining levels, and therefore it's unnecessary to provide an external powder sorting machine to deliver the coarse powders back to the chamber.
5. The collision plates perform the maximum kinetic energy.

$$P1 \text{ (power of the collision plate)} = \tfrac{1}{2} \times M \times V^2$$

For a test using a 36 HP prototype machine:

$M$ (mass of the rotary cutters)=30 cm×2 cm×50 cm×8 (specific gravity)=24 kg $V$ (velocity of the rotary cutters)=30 cm×3.14×3600 (rpm)=6 m/s (maximum)

$P2$ (power of the powders)=$\frac{1}{2}\times m\times v^2$ m (mass of the powders)~$10^{-6}$ v (velocity of the powders)

P2<<P1.

Since the powders (power=P2) can be pulverized by colliding with each other, (jet mill); it will be more effective to fine the powders by colliding the powders (power=P1) with the collision plates (power=P2). Numbers of the fined powders will vary with different collision angles.

6. Less consumed material

Steel will be distorted and deformed at a rotary speed larger than 130 m/s; and impact of the powders having sizes D50<20 μm and velocity<130 m/s can be neglected for the steel and its lining. In the present invention, rotary speed of the collision plate and velocity of the powders are controlled to be less than 130 m/s, so that the powders can be efficiently fined and consumption of the material is reduced. In general, a special surface treatment is unnecessary for the plates unless ultra-rigid powders are applied.

7. Less electricity demand

Cost for fining powders will be very low as the total power consumption is greatly reduced.

BRIEF DESCRIPTION OF THE DRAWINGS

FIG. 7 shows the diameter data of the fined Portland Type-I cement.

DETAILED DESCRIPTION OF THE PREFERRED EMBODIMENTS

To describe technology, objects and effects of the present invention in detail, preferred embodiments are exemplified with their drawings.

Figure 1:
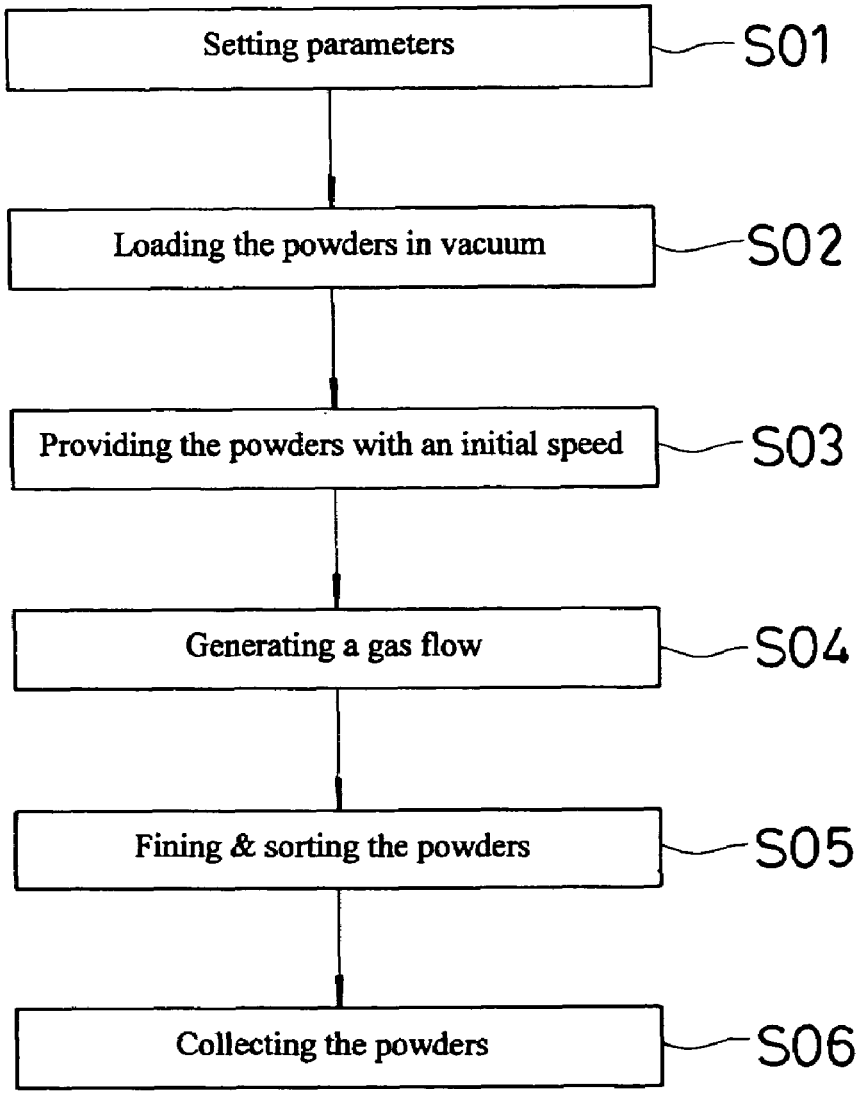
FIG. 1 shows the process of the present invention.

FIG. 1 shows the process of the present invention.

(I) Setting Parameters (SO1)

Through the control system disposed in the control panel (1), temperature and pressure inside the chamber, frequency of the motors of the powder sorting machine and the collision plates, loading rate and protection elements are set.

(II) Loading the Powders in Vacuum (SO2)

The powders having size D50<20 μm are loaded into the chamber (4) via the loading means (2).

(III) Providing the Powders with an Initial Speed (SO3)

The powders loaded by the loading means (2) will be further accelerated by a accelerator (3) to give an initial speed more than 10 m/s. The accelerator (3) can either be disposed outside the chamber (4) or have its vanes inside the chamber (4) by coupling with a shaft thereof. Rotary speed of the vanes=12 cm (diameter)×3.14×3,600 (rpm)=22.4 m/s.

(IV) Generating a Gas Flow (SO4)

A powder sorting machine (5) disposed inside the chamber (4) and a blower mounted on an outer wall of the powder collector (6) are provided to pump the air from the chamber (4). An air supply valve (7) with an ultra-fine filter is disposed beneath the chamber (4) to keep the air flowing upwardly and the chamber (4) in a low pressure ranging 0~1 atm by controlling inlet flow rate larger than the outlet. The powders can move free in the low-pressure chamber (4) having a low air density without resist, and thus cross the force field (F) to collide with the collision plates with the maximum kinetic energy. When the powders are suspending or flying in the air, frictions therebetween will disappear and thus kinetic energy thereof is preserved, temperature will not raise with frictions and no aggregation occurs.

(V) Fining & Sorting the Powders (SO5)

The powders with an initial speed higher than 10 m/s enter into the chamber (4) and are accelerated to 56 m/s after continuously colliding with the rotating collision plates (8) driven by frequency-variable motors (81).

$P$ (power)=$\frac{1}{2}\times M$ (mass)$\times V^2$ (velocity)

Figure 2:
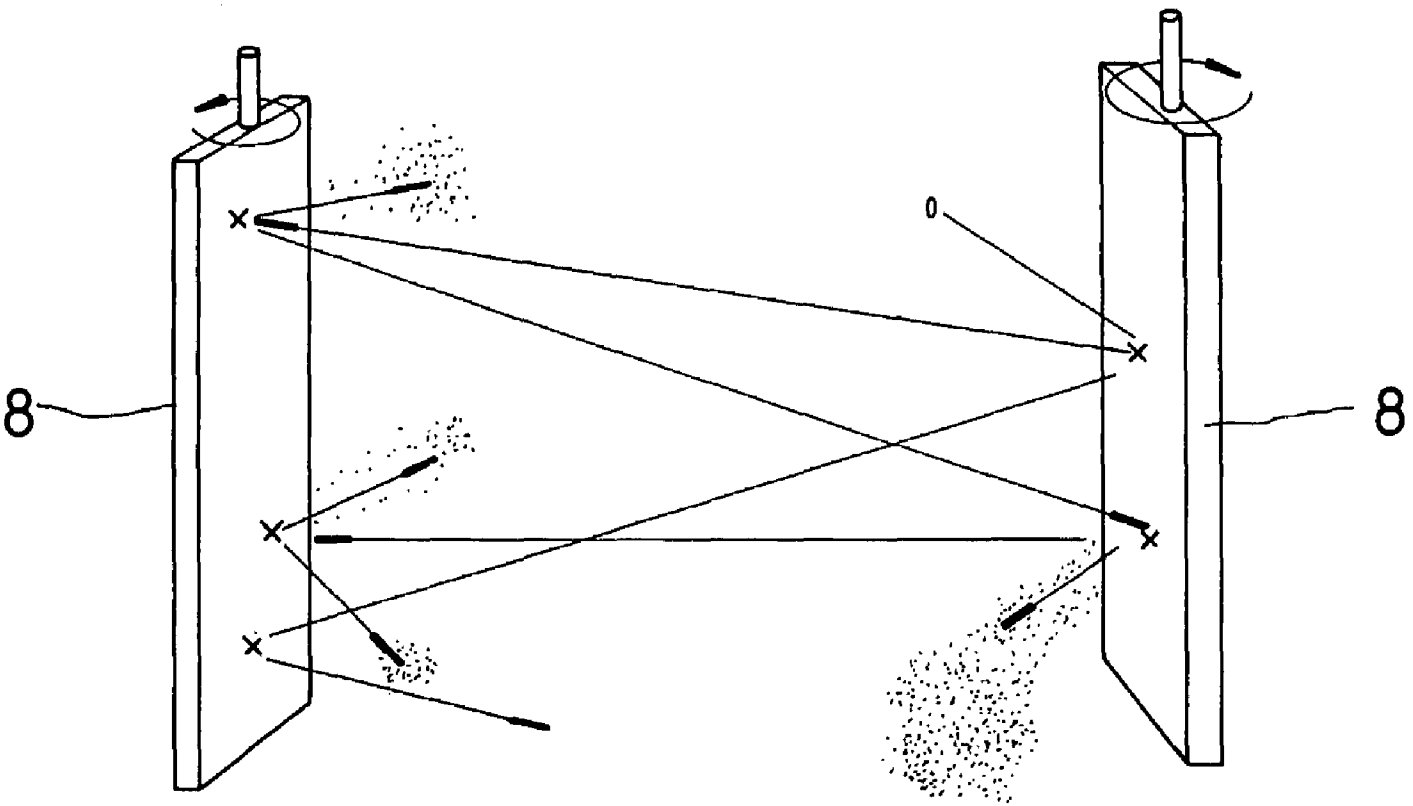
FIG. 2 shows collision of the powders with the collision plates.
Figure 3:
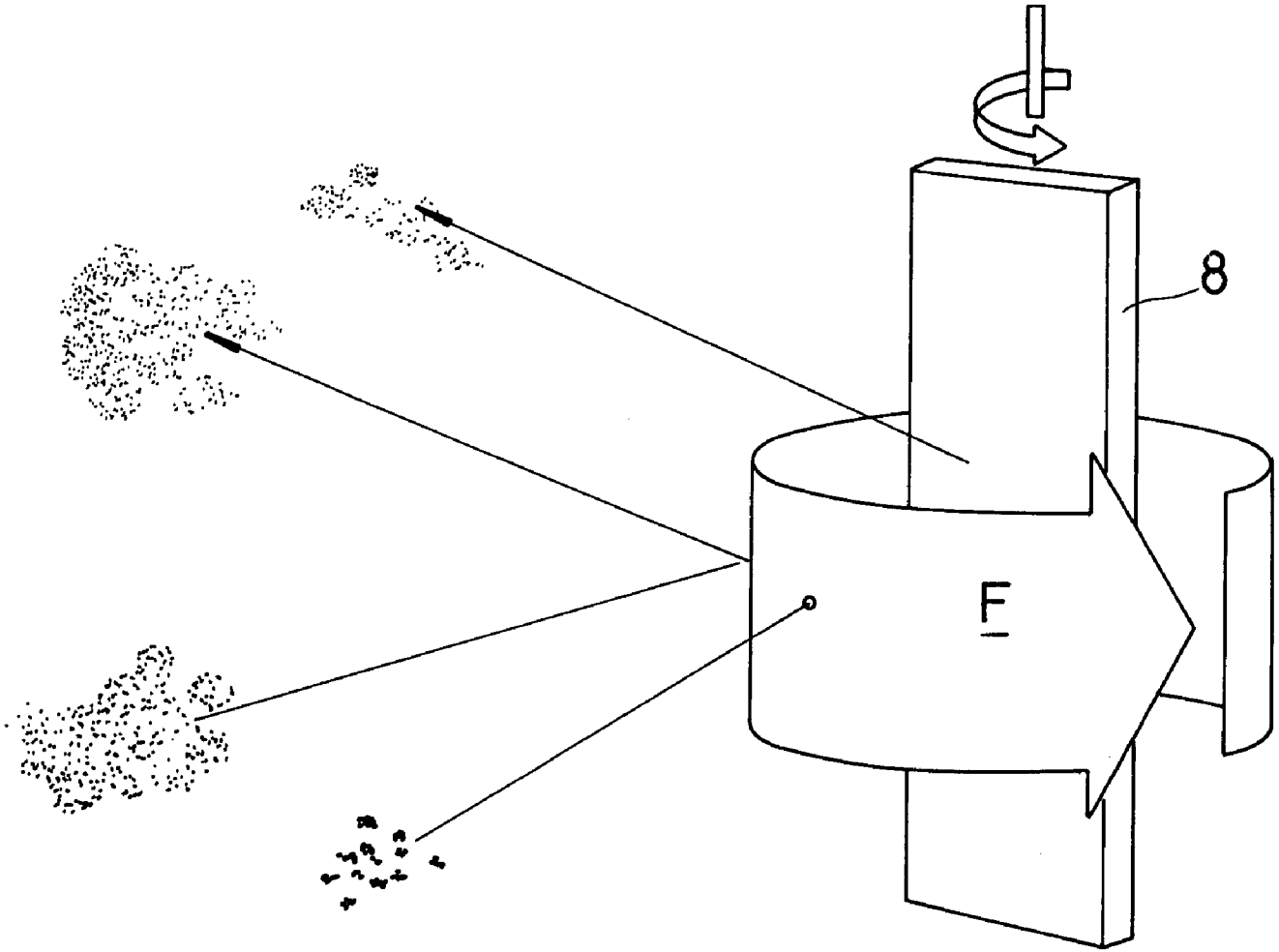
FIG. 3 illustrates the sorting-mechanism of the powders.

$M$ (mass of the rotary cutters)=30 cm×2 cm×50 cm×specific gravity=24 kg $V$ (velocity)=30 cm×3.14×3,600 rpm=203 km/hr (maximum)=339,120 cm/min=56 m/sec If the collision energy is larger than aggregation force of the powders, the powders will be fined instantly; i.e., number of the fined powders is proportional to the destruction energy, also referring to FIG. 2. The collision plates (8) rotate fast and thus generate gas flows of the same direction and a weak force field (F), so that coarse and fine powders can be separated respectively at a collision area and a non-collision area as shown in FIG. 3. The fined powders having too small mass and power to cross the force field (F) of the collision plates (8) will be lifted by the inverse air flow and sucked away by the powder sorting machine (5). The coarse powders have sufficient kinetic energy to cross the force field (F) and thus collide with the collision plates (8) to produce more fined powders. The fined powders having sizes smaller than a threshold will be sucked away by the powder sorting machine (5); and the coarse powders entering into the powder sorting machine (5) will be discharged and return to the collision area.

(VI) Collecting the Powders (SO6)

The fined powders are sucked by the powder sorting machine (5) and the blower mounted on the outer wall of the powder collector (6), and then collected in the powder collector (6). The powder sorting machine (5) is preferably fine-tune and frequency-variable.

In addition, the wind pressure inside the chamber (4) can be controlled by adjusting wind velocity through the air supply valve (7) and thus size of the fined powders can be determined. The sorting process can be controlled by the powder sorting machine (5) and the threshold of powder sizes can be minimized by adjusting the wind pressure to a very low level.

In the chamber (4), it's preferred to arrange multiple collision plates (8) rotating in the same direction or opposite directions with respect to the next plate. The collision plates are typically rotary cutters in the form of plates; and also circles, polygons, combs or blades.

Figure 4:
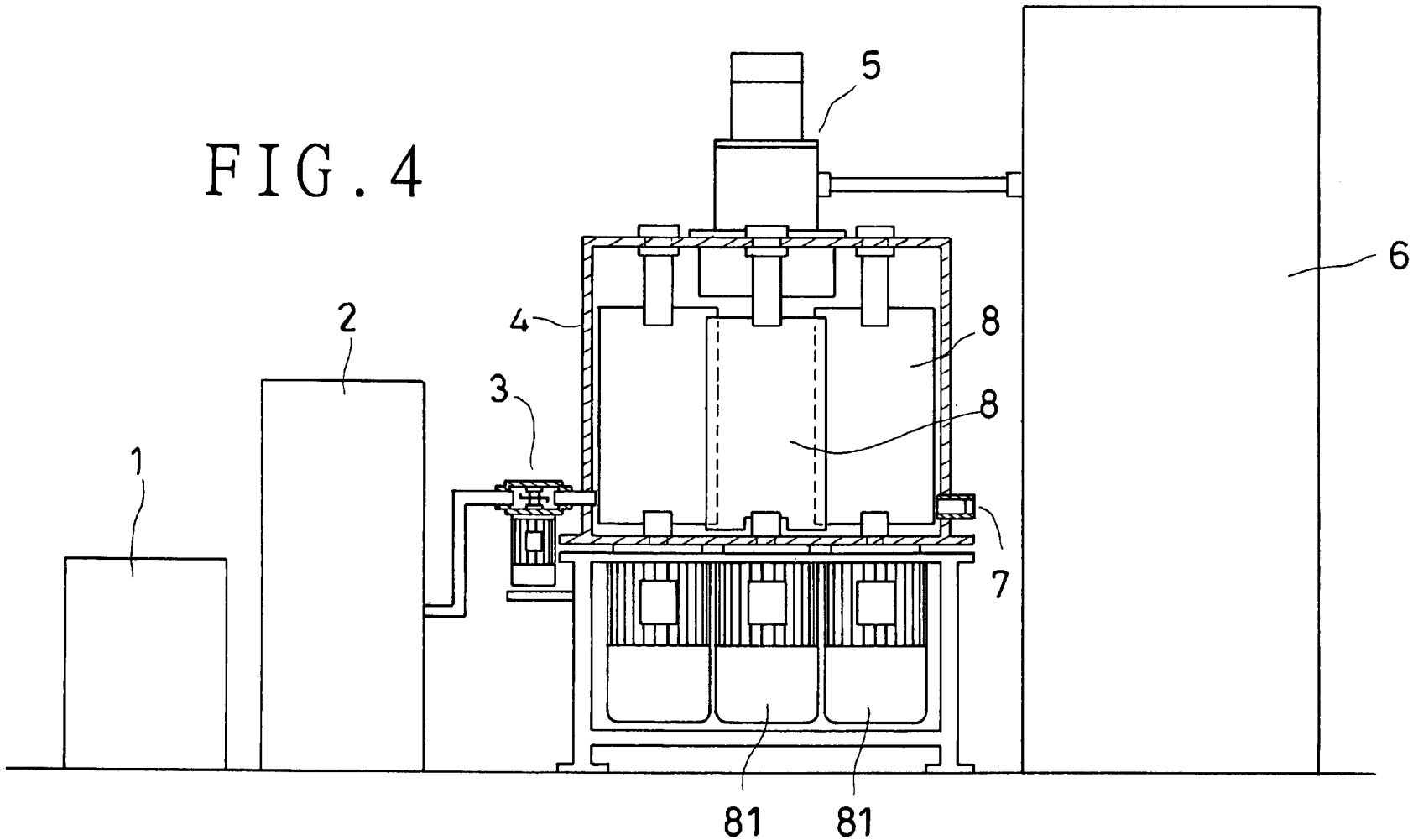
FIG. 4 shows the fining apparatus with multiple rotary cutters.

FIG. 4 shows the fining apparatus with multiple rotary cutters, which includes components as follows.

1. Control Panel (1)

The control panel (1) includes an indicator for showing temperature inside the chamber, an indicator and instrument for showing and controlling pressure inside the chamber, instrument for controlling frequency of the motor of the powder sorting machine, instrument for controlling frequency of the motors of the collision plates, instrument for controlling loading material and protection elements.

2. Loading Means (2)

The loading means (2) can load the powders into the chamber (4) in a vacuum manner.

3. Chamber (4)

The chamber (4) is connected to the accelerator (3) which can be mounted outside the chamber (4) or has its vanes inside the chamber (4) and coupling with the drive shaft. The rotary speed of the vanes is about 22.4 m/s[=12 cm (diameter)×3.14×3,600 (rpm)], and therefore the accelerator (3) may give the powders an initial speed more than 10 m/s. In the chamber (4), each of the collision plates (8) has plane surfaces and is driven by its respective motor (81). The motors (81) are preferably frequency-variable, and the collision plates (8) rotate either in the same direction or in opposite directions with respect to the next plate. The collision plates are typically rotary cutters in the form of plates; and also circles, polygons, combs or blades.

4. Powder Sorting Machine (5)

The powder sorting machine (5) with a frequency-variable motor is disposed outside the chamber (4), and connected to the air supply valve (7) with an ultra-fine filter beneath the chamber (4) to control velocity and flow rate of the supplied air. The pressure in the chamber (4) is kept low by controlling the inlet air flow lower than the outlet, and thus the air will flow upwardly. The air supply valve (7) with an ultra-fine filter can be also connected to other gas in accordance with demands of the powders.

5. Powder Collector (6)

The blower mounted outside the powder collector (6) and the powder sorting machine (5) are provided to pump the fined powders into the powder collector (6).

To verify effects of the present invention, tests are performed and related data are described as follows.

A prototype machine having three rotary cutters and manufactured according to the above principles is used in the tests, and power consumptions thereof are as follows:

the loading means=1 HP
each of the collision plates=10 HP
the accelerator of the powders=1 HP
the powder sorting machine=2 HP
the powder collector=2 HP
total power=1+3×10+1+2+2=36 HP
voltage=380V.

Test 1

Powders: Portland Type-I cement purchased from Taiwan Cement Co., D50<20 μm

In side pressure of the chamber: 190 tar (=0.25 atm)
Electricity consumption: 27 Watt/hr
Rotary speed of the motor: 3,600 rpm and 6,400 rpm Fining Results:

D50<2.5 μm
specific surface area=10,000 $cm^2/g$
specific gravity=2.97
Yield: 20.8 kg/h (3,600 rpm) 38.1 kg/h (6,400 rpm)

Analysis

Figure 5:
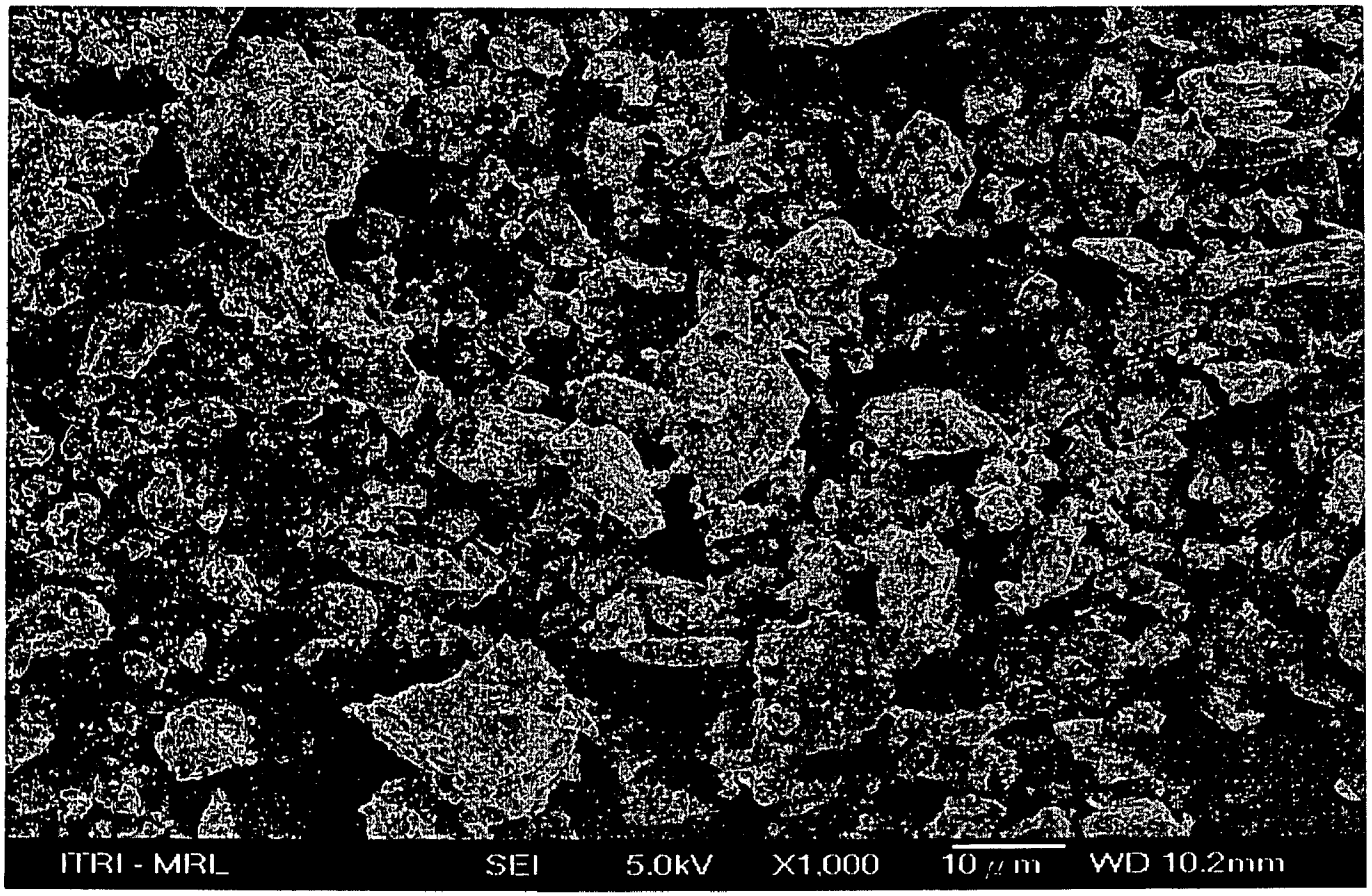
FIG. 5 shows the image (magnitude 1,000) of the Portland Type-I cement purchased from Taiwan Cement Co.
Figure 6:
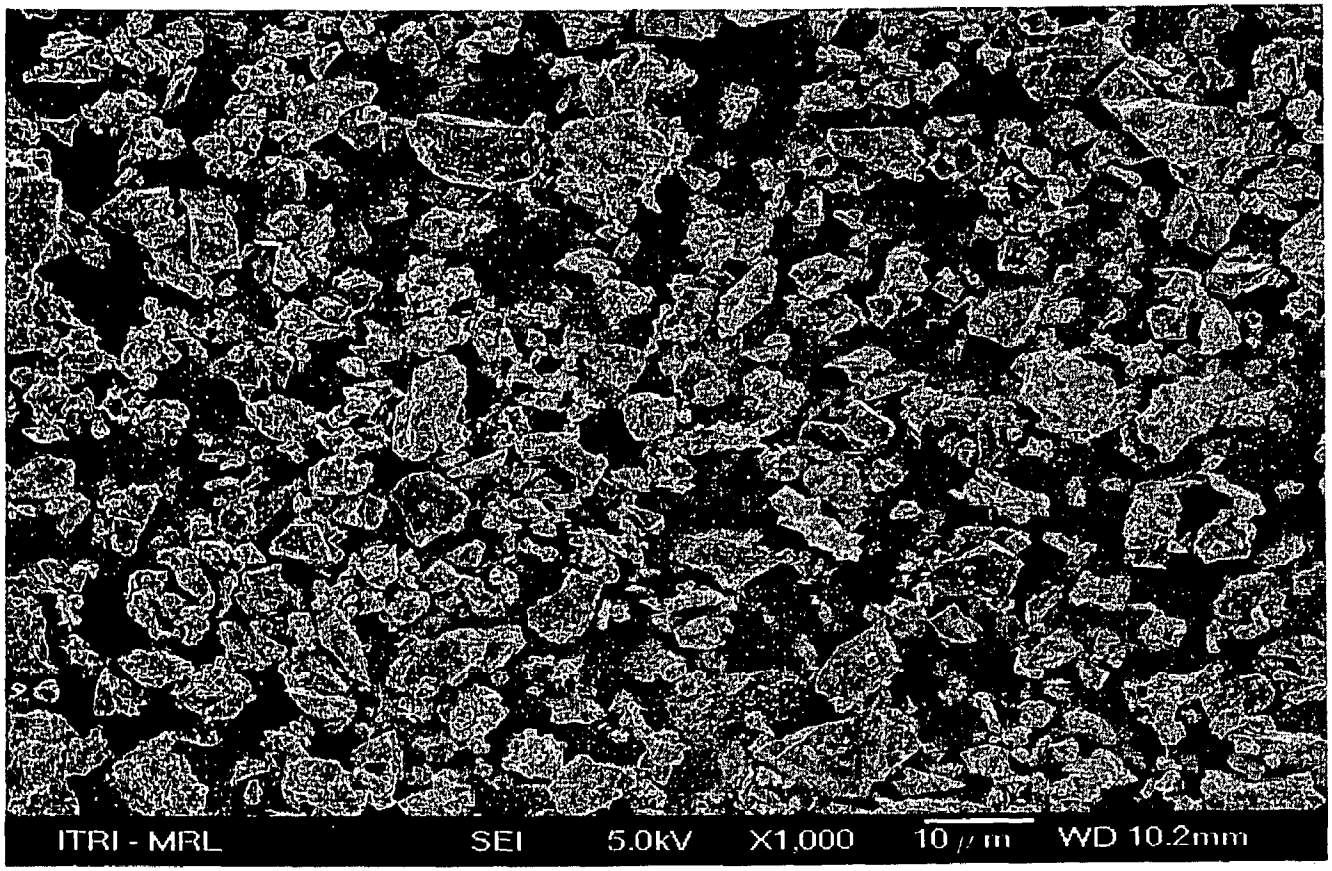
FIG. 6 shows the image (magnitude 1,000) of the Portland Type-I cement having sizes D50<2.5 μm.

1. FIG. 5 shows the image (magnitude 1,000) of the original cement having sizes D50<20 μm.
2. FIG. 6 shows the image (magnitude 1,000) of the fined cement having sizes D50<2.5 μm.

Test 2

Powders: Portland Type-I cement purchased from Taiwan Cement Co., D50<20 μm

In side pressure of the chamber: 150 tar (<0.25 atm)
Electricity consumption: 26.3 Watt/hr
Rotary speed of the motor: 3,600 rpm and 6,400 rpm Fining Results:

D50<1.75 μm
specific surface area=11,000 $cm^2/g$
specific gravity=2.91
Yield: 11.7 kg/h (3,600 rpm) 20.2 kg/h (6,400 rpm)

Analysis

Figure 8:
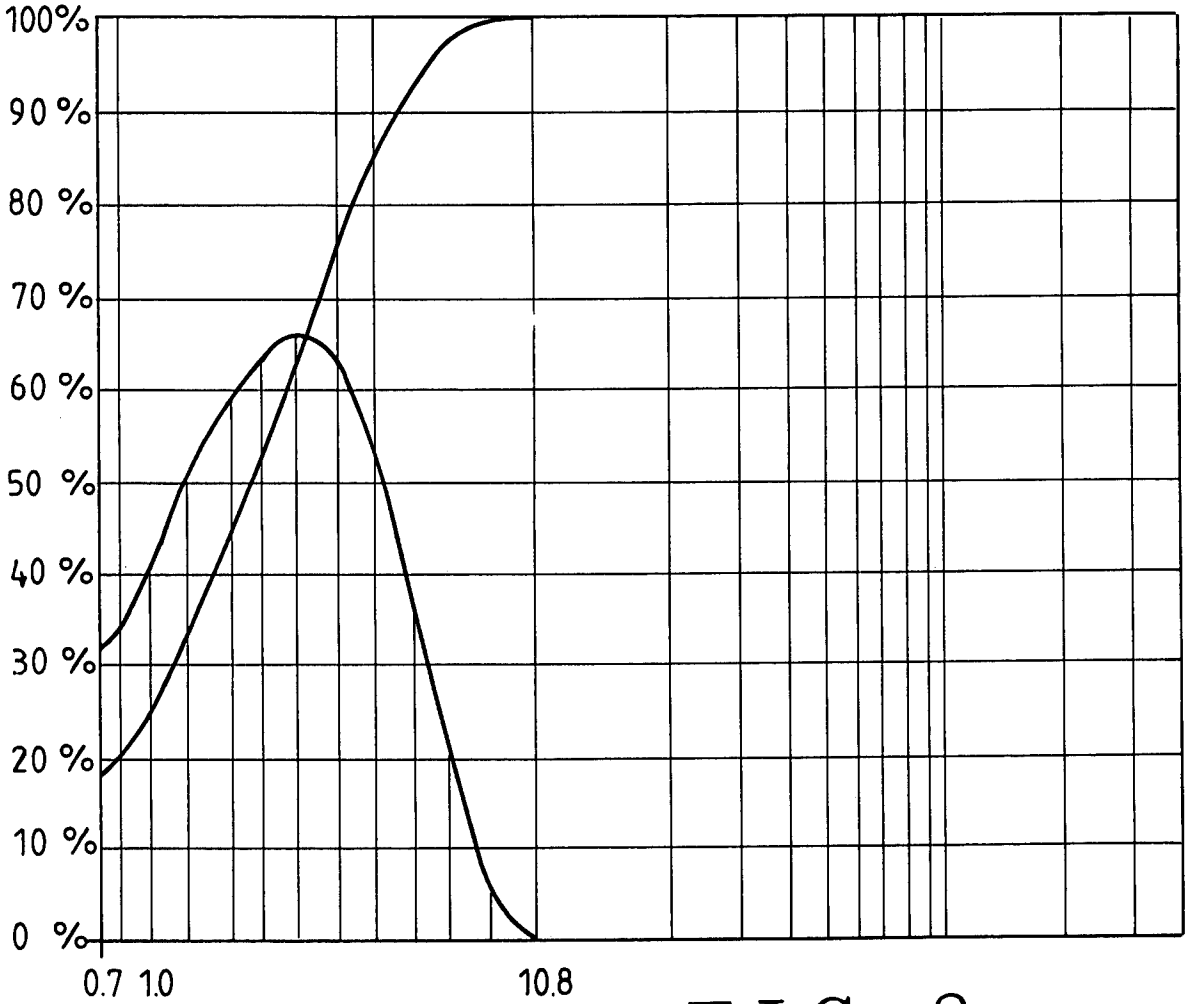
FIG. 8 shows the diameter curve of the fined Portland Type-I cement.
Figure 9:
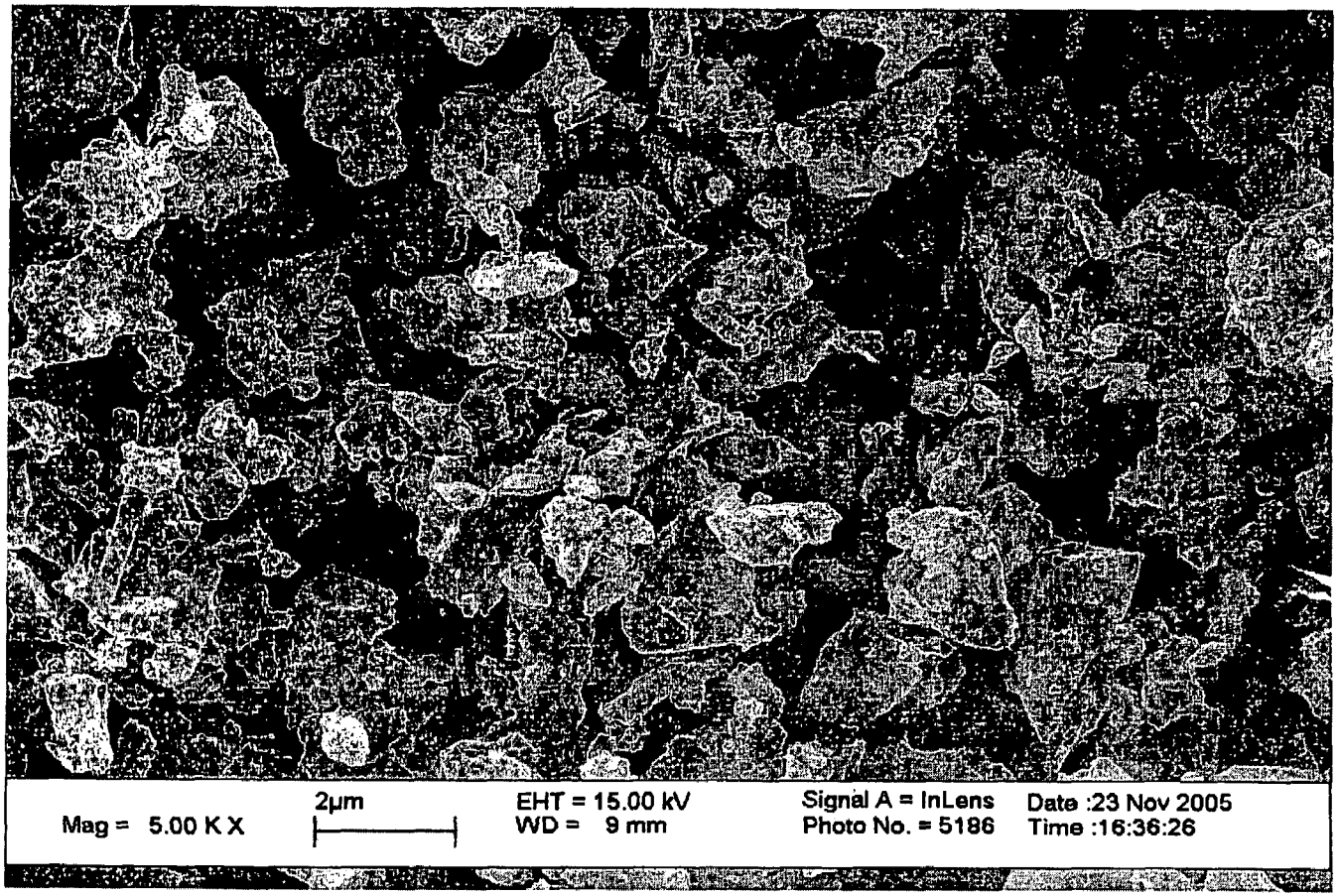
FIG. 9 shows the image (magnitude 5,000) of the Portland Type-I cement having sizes D50<1.75 μm.
Figure 10:
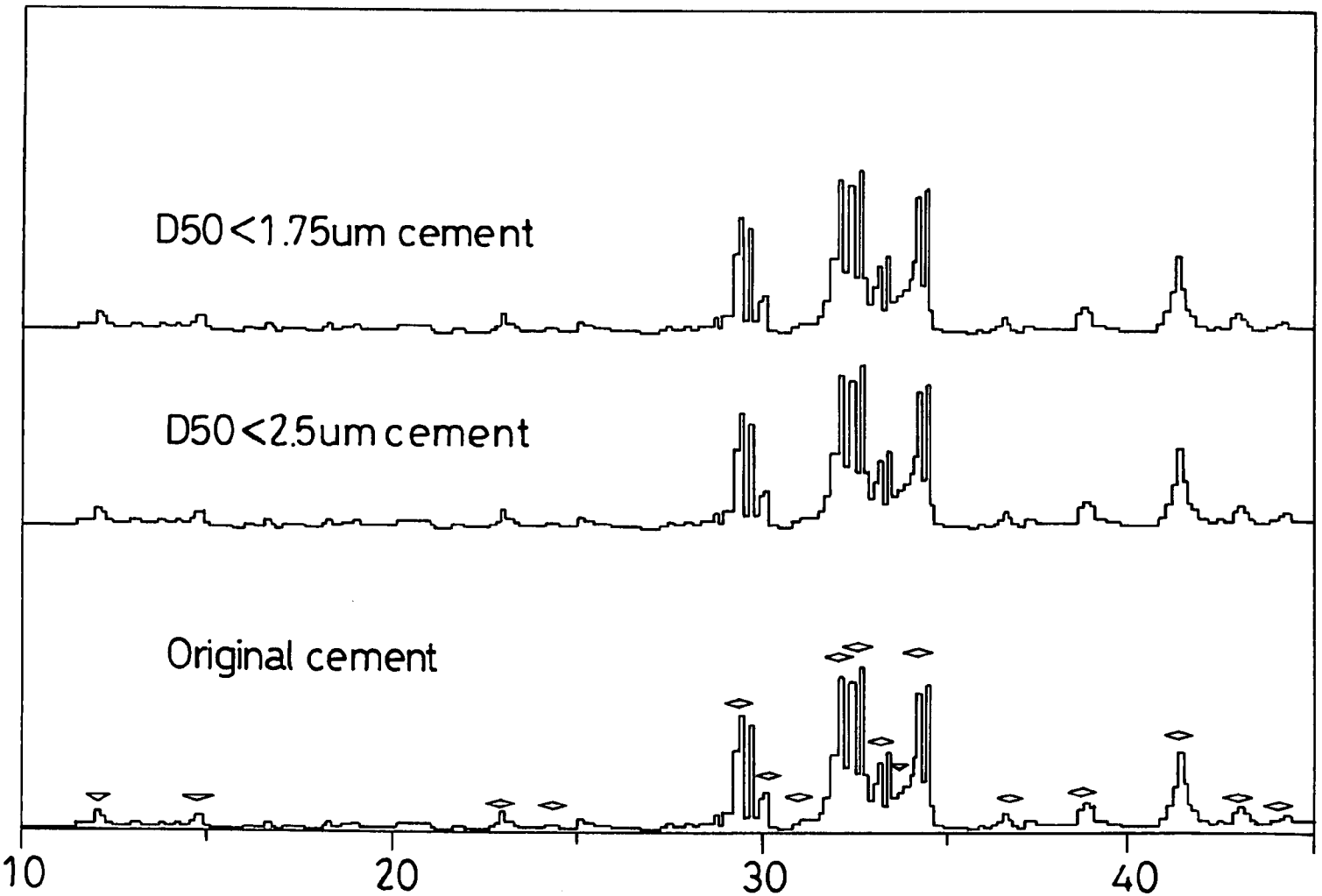
FIG. 10 shows the X-ray diffraction of the cement.

1. FIGS. 7 & 8 respectively show the diameter data and curve of the fined cement.
2. FIG. 9 shows the image (magnitude 5,000) of the fined cement having sizes D50<1.75 μm.
3. FIG. 10 compares waveforms of the X-ray diffraction of the fined cement (D50<2.5 μm and D50<1.75 μm) and the original cement, and they are very similar.

As shown in the tests, the present invention exhibits advantages as follows:

1. Saving Power

The present invention provides continuous collisions in a low pressure without repeating the sorting grinding processes, and therefore electricity consumption is greatly reduced.

2. Less Consumed Material

Steel will be distorted and deformed at a rotary speed larger than 130 m/s. In the present invention, rotary speed of the collision plate and velocity of the powders are controlled to be less than 130 m/s, so that the powders can be efficiently fined and the material consumption is reduced. In general, a special surface treatment is unnecessary for the plates unless ultra-rigid powders are applied.

3. Simple Apparatus

The present invention provides the low-pressure chamber with rotating collision plates and the powder sorting mechanism, so that the apparatus is simple and can be installed with lower cost.

4. Good Comparability

The apparatus of the present invention is comparable with other apparatuses, for example, arranged next to a large ball mill or a roller mill.

5. Dry Process

In the present invention, the powders with an initial speed directly collide with the rotating collision plates without adding a media, and therefore no media need to be separated and recycled.

6. Low Temperature

In the present invention, the powders with an initial speed directly collide with the rotating collision plates, and therefore friction between the powders is avoided and temperature is remained to give stable quality of the powders.

7. No Electrostatic Phenomenon

In the present invention, both the collision plates and the chamber are made from conductive metal.

8. No Aggregation

The powders move fast during the fining process without compacting each other, and therefore aggregation will not occur.

9. Scaling Up

By increasing volume and height of the chamber, driving power, or mass or number of the collision plates, yield can be proportionally increased.

While the present invention has been described and explained with the preferred embodiments, one skilled in this art may make modifications according to these embodiments, and such modifications should belong to the scope of the present invention.

What is claimed is:

1. A method for fining powders, comprising:

loading powders into a chamber said chamber being maintained at a stable and low pressure and colliding the powders with plane surfaces of one or more collision plates rotating at a high speed for comminuting the powders;

sorting the coarse and fine powders respectively to a collision area and a non-collision area with gas flows of the same directions and a weak force field generated by the rotating collision plates;

discharging the fine powders external the chamber by driving said fine powders acted upon by a converse gas flow, and comminuting the coarse powders which have sufficient kinetic energy to cross the force field and collide with the plane surfaces of the collision plates;

whereby, the powders are efficiently pulverized and sorted in the chamber.

2. The method of claim 1, further comprising a parameter-setting process, a delivering process and a collecting process; so that parameters about delivering velocity, rotary speed of the collision plates and kinetic energy of the powders are set, the powders are delivered into the chamber in a vacuum manner and then collected after fined.

3. The method of claim 1, wherein the gas flow and the force field are controlled by adjusting the stable pressure and rotary speed of the collision plates in the chamber, so that the coarse and fine powders are sorted to the collision area or the non-collision area, and the size of the fine powders is determined.

4. The method of claim 3, wherein the collision plates in the chamber are driven with frequency-variable motors and the rotary speeds thereof are controlled by changing rotary speed of the motors according to kinds and sizes of the powders.

5. The method of claim 1, wherein the collision plates are rotary cutters in the form of plates, circles, polygons, combs or blades.

6. The method of claim 1, wherein the collision plates rotate either in the same direction or in opposite directions with respect to the next plate.

7. The method of claim 1, wherein the sorting procedure is carried out either in the same chamber as the collision procedure or in an external powder sorting machine from which the course powders are delivered back to the chamber for fining again.

8. The method of claim 1, wherein the collision plates are driven in the vertical, horizontal, inclined or both-vertical-and-horizontal form.

9. The method of claim 1, wherein the chamber has an inside pressure ranging from 0 atm to 1 atm.

* * * * *